United States Patent [19]

Konstant et al.

[11] 4,285,436

[45] Aug. 25, 1981

[54] INTEGRAL LOCKING TAB FOR STORAGE RACKS

[75] Inventors: Anthony N. Konstant, Mount Prospect; John J. Weider, Arlington Heights, both of Ill.

[73] Assignee: Speedshelf International, Inc., Skokie, Ill.

[21] Appl. No.: 973,742

[22] Filed: Dec. 26, 1978

[51] Int. Cl.[3] ..... A47F 5/00

[52] U.S. Cl. ..... 211/192

[58] Field of Search ..... 211/191, 192, 208

[56] References Cited

U.S. PATENT DOCUMENTS

| | | | |
|---|---|---|---|
| 3,042,221 | 7/1962 | Rasmussen . | |
| 3,055,462 | 9/1962 | Steele | 211/191 X |
| 3,142,386 | 7/1964 | Skubic | 211/191 |
| 3,303,937 | 2/1967 | McConnell . | |
| 3,626,487 | 12/1971 | Seiz . | |
| 3,672,515 | 6/1972 | Rous | 108/54 |
| 3,693,556 | 9/1972 | Rous | 108/109 |
| 3,862,691 | 1/1975 | Mori et al. | 211/191 |
| 4,067,445 | 1/1978 | Derclaye | 211/191 |
| 4,129,279 | 12/1978 | Burkholder | 211/192 X |

FOREIGN PATENT DOCUMENTS

| | | | |
|---|---|---|---|
| 670899 | 9/1963 | Canada | 211/192 |
| 1123315 | 8/1968 | United Kingdom | 211/192 |

*Primary Examiner*—Ramon S. Britts
*Assistant Examiner*—Robert W. Gibson, Jr.
*Attorney, Agent, or Firm*—Fitch, Even, Tabin, Flannery & Welsh

[57] ABSTRACT

An integral locking arrangement adapted for inclusion in different adjustable storage racks. Columns having rows of spaced apertures are interconnected by beams that carry suitable connectors, e.g., transverse lugs which are inserted into appropriate apertures. Downward movement of the lugs creates a camming action that solidifies the connection and aligns an integral locking tab with an aperture. Displacement of the locking tab causes its head to reside in an aperture in the column and prevents upward disengaging movement until the locking tab is withdrawn.

3 Claims, 11 Drawing Figures

Fig. 1.
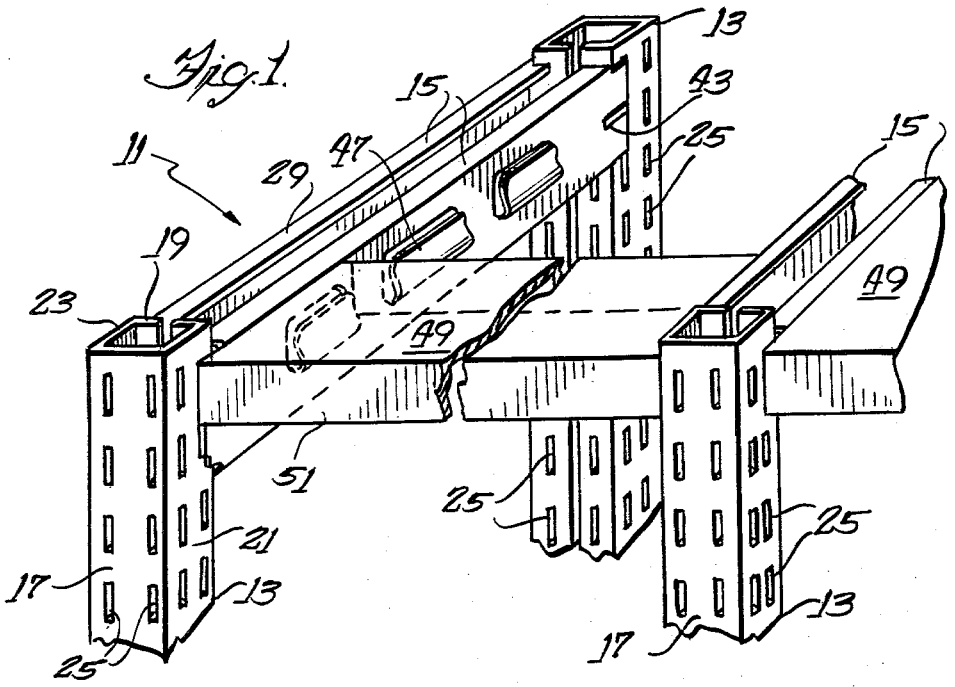
Fig. 2.
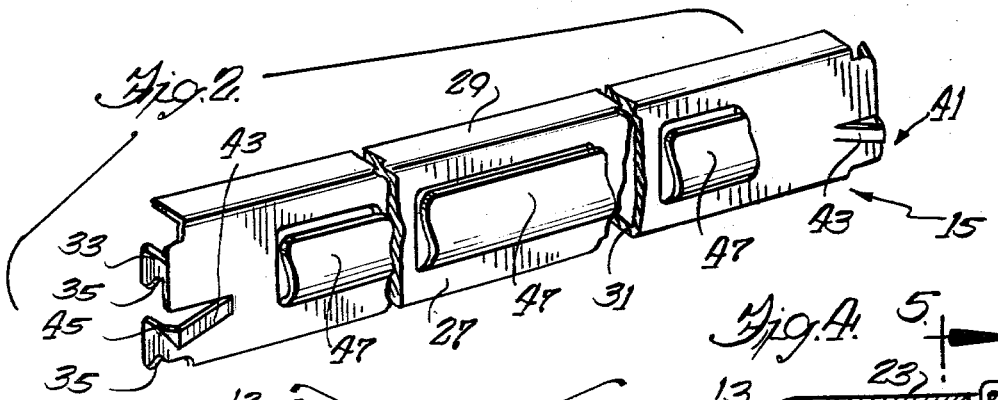
Fig. 3.
Fig. 4.
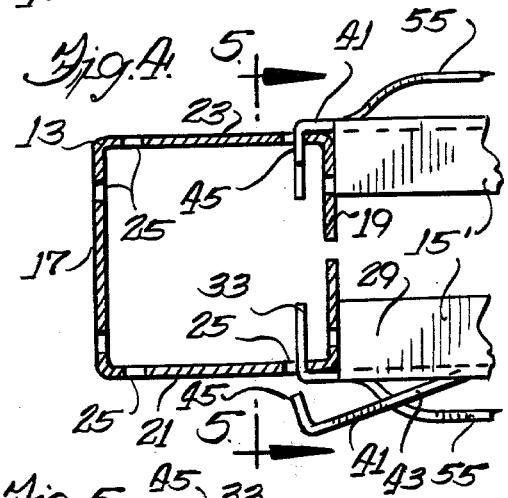
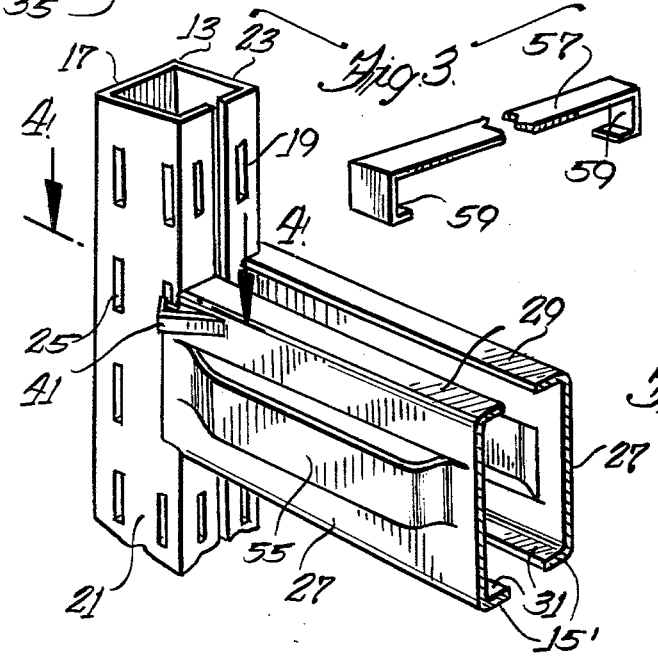
Fig. 5.
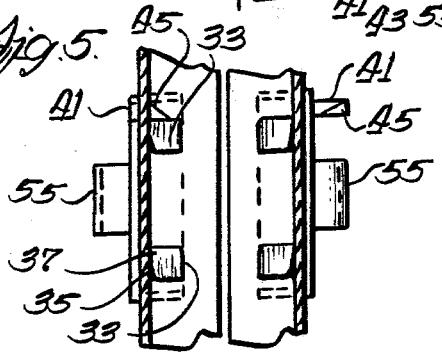

INTEGRAL LOCKING TAB FOR STORAGE RACKS

BACKGROUND OF THE INVENTION

This invention relates to metal structures wherein horizontal members are supported upon posts at different vertical levels, and more particularly to storage installations wherein a horizontal beam is adjustably supported at a desired vertical level by the entry of tab or lug means carried by the beam into openings spaced vertically along the posts.

Many metal framework structures have been developed which basically employ vertical columns or posts that are interconnected by horizontal members or beams which can be adjustably positioned at different vertical levels on the posts. In storage installations, these horizontal beams generally, either directly or indirectly, support the load which the framework carries and transfer it to the posts. For example, in some storage rack installations, e.g. certain types of pallet racks, the load may be supported directly upon horizontal beams; whereas in other installations, shelves or decking is supported from opposite horizontal beams. The field of adjustable storage racks has, in the past 15 years or so, become highly sophisticated and versatile in its design so as to accommodate the storage of almost any type of merchandise. A particularly efficient design for metal shelving has recently been developed and is depicted in U.S. patent application Ser. No. 831,524, filed Sept. 8, 1977. This design utilizes posts having spaced pairs of parallel vertical slots which accommodate connectors formed at the ends of the horizontal beams. The beams, in turn, include lips for the support of individual metal shelves, and the design is such that the entire assembly can be accomplished without the use of nuts and bolts.

In the above-described shelving system, as well as in pallet racks, it is important that, once installed, the beams do not become inadvertently detached, which is consideration that grows out of the fact that such framework is designed to be capable of easy and simple erection. As a result, a number of different latching or locking arrangements have been developed, a few examples of which are depicted in U.S. Pat. Nos. 3,637,087, 3,626,487, 3,303,937, 3,144,944, 3,070,237 and 3,042,221. None of these arrangements is considered to be totally satisfactory, and none has been truly applicable to a number of different structural connections of this general type.

SUMMARY OF THE INVENTION

The present invention provides an improved locking arrangement for horizontal framework members which permits them to be easily installed at a desired vertical location, usually between a pair of posts, and very simply locked in place against inadvertent detachment. This locking arrangement employs integral locking tabs which are separate from the beam connectors and which may be received in openings in the posts already provided for the connectors. After installation of the horizontal beams, displacement of the tab so that it enters one of the openings prevents detachment of the horizontal beam without first withdrawing the metal tab.

Specific objectives of the invention will be apparent from the following detailed description of some preferred embodiments of metal framework, when read in conjunction with the accompanying drawings wherein:

FIG. 1 is a fragmentary perspective view of a rack structure which incorporates improved horizontal members embodying various features of the invention;

FIG. 2 is an enlarged fragmentary perspective view of the improved horizontal member shown in FIG. 1;

FIG. 3 is a fragmentary perspective view of a modified version of framework similar to that shown in FIG. 1 with one horizontal member installed but yet to be locked in position;

FIG. 4 is an enlarged sectional view taken generally along line 4—4 of FIG. 3;

FIG. 5 is a fragmentary sectional view, slightly reduced in size, taken along the line 5—5 of FIG. 4;

DESCRIPTION OF THE PREFERRED EMBODIMENTS

Figure 6:
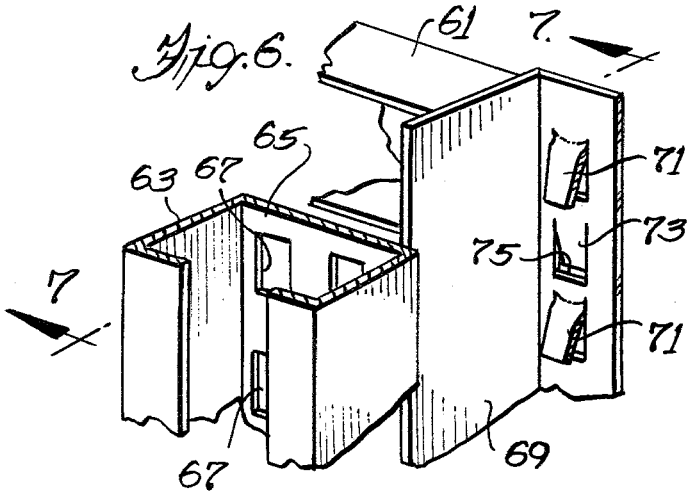
FIG. 6 is an exploded perspective view showing a post and a beam plus an attached connector of a different design embodying various features of the invention.

FIG. 1 illustrates a metal framework 11 designed for use as a storage installation wherein a plurality of vertical posts 13 are interconnected in pairs by horizontal beams or support members 15. The basic installation requires at least four vertical posts 13; however, it should be understood that the design is such that it may be expanded substantially indefinitely, both fore-and-aft and laterally, to provide an array of nearly any desired size. Although only three posts 13 are illustrated in FIG. 1, the shelf pattern shown would require the presence of at least six posts.

The columns or posts 13 are of rectangular cross section, preferably square, and thus provide four faces at right angles to one another. With respect to the orientation depicted in FIG. 1, the faces are hereinafter referred to as a front or outward face 17, a rear or inward face 19 and a pair of side faces 21,23. All four faces are provided with a series of spaced vertical slots or apertures 25 arranged in two parallel rows, with the slots being aligned between rows so as to provide slots in each of the rows at the same predetermined, spaced vertical intervals. The posts 13 are fabricated from prepunched strips of steel which are rolled to their tubular configuration. The two edges of the rolled, square tube are preferably located in the center of the rear face 19, and these edges can be welded together for additional strength or simply left open, depending somewhat upon the gauge or thickness of the steel which is used and depending upon the load capacity for which the storage installation is designed to support.

The horizontal beams 15 run fore-and-aft and interconnect the posts 13 in pairs, and the shelves provide lateral interconnection in the illustrated version. However, at alternating vertical levels, the beams 15 can be run laterally (and the shelves fore-and aft) to increase the overall stability of the storage framework. As best seen in FIG. 2, the beam 15 is a shallow channel the web 27 of which constitutes the main vertical wall, with the flanges 29 and 31 of the channel extending, respectively, from the upper and lower edges of the web 27. The beams 15 are joined to the posts 13 by connectors which are integral with the material from which the beams 15 are formed; however, in other designs a connector plate may be separately fabricated and then attached, as by welding, as illustrated hereinafter.

Each beam 15 is formed with two lugs or connector parts 33 at each end which are spaced vertically apart a distance equal to the spacing between the slots 25 of the posts 13. The lugs 33 project at substantially right angles to the plane of the vertical web 27 of the channel. The lugs 33 have a generally hook-like shape in the form of a slanted rear edge 35 that engages the bottom edge of the receiving slot 25 and a narrower neck portion 37 above the rear edge.

When the lugs 33 at each end of the beam 15 are inserted into slots 25 at the appropriate vertical level and the beam is then moved downward, the dimensioning is such that the slanted edge 35 cams the inner surface of the web 27 into tight contact with the vertical side face 21 of the post. Once the beam reaches this lower position (See FIG. 5) with the narrow neck 37 of the lug aligned in the slot 25, the upper region of the slot 25 is unoccupied. By filling this region, detachment of the beam 15 from the post 13 is prevented because it will no longer be possible to raise the beam to a position where the head of the lug 33 can be withdrawn from the slot 25.

A locking tab 41 is provided to fill this upper space in the slot 25. The locking tab 41 has a root portion 43 which leads to a head 45 which is generally aligned with the plane of the lug. The beams 15 are stamped from metal of a suitable gauge, for example 16 gauge steel, and the locking tab 41 is struck from the metal blank during the fabrication process. Accordingly the tab 41 is formed as an integral part of the beam 15, being struck from what would otherwise be part of the vertical web 27 of the channel. The construction is such that the root portion 43 of the tab is offset at a small angle, usually less than 30°, from the vertical web 27 so that the head 45 is spaced slightly back from the lug 33 where it does not interfere with the joinder of the horizontal member to the post 13. The head 45 is tapered slanting upward from a narrow front end, as best seen in FIG. 5.

Once the beam 15 has been joined to the post 13, as depicted in FIGS. 3 and 4, the locking tab 41 is displaced so that the root portion 43 lies in the plane of the web, as by tapping the rear end of the head 45 gently with a hammer. Even if lug 33 is not all of the way down in the slot, the narrow front end of the head 45 will enter the vacant upper region of the slot, and its slanting edge will cam the beam end downward into place. In the installation illustrated in FIGS. 4 and 5, one tab 41 is shown in its locked position, and the other tab is shown in the unlocked position. Once the locking tab head 45 occupies the upper portion of the slot, there is no way that the horizontal support member 15 can be inadvertently detached from the post, which could otherwise occur as a result of an upward blow or as a rebound reaction from the dropping of a load unto a shelf. If it is desired to disassemble the framework 11 for some reason or to change the height of the beam 15, the locking tab 41 is removed by using a blade of a screwdriver or some other suitable tool to pry the tab back to the offset position depicted in FIGS. 2 and 3. The resiliency of the steel permits the tab 41 to be flexed a reasonable number of times without fatiguing.

The vertical web 27 of the horizontal support member 15 illustrated in FIGS. 1 and 2 is punched to provide a series of upwardly extending lips or supports 47 which engage the flanged edge of shelf panels 49, as depicted in FIG. 1. Each shelf 49 is preferably formed from sheet metal which is shaped to present a main rectangular central panel, the edges of which are rolled to form a depending peripheral skirt 51 which gives rigidity to the shelf and fits between the punched-out lip 47 and the vertical wall 27 of the horizontal support member to effect its attachment. In the installation shown in FIG. 1, the support lips 47 are visible on the horizontal member 15 which interconnects the two left-hand posts, and the two support members 15 which are connected to the right-hand post 13 are also formed with such punched-out lips to support the shelf panels 49. If the framework array 11 were to end with the two left-hand posts shown, then a horizontal member could be provided wherein the vertical web was imperforate but which in all other respects would be similar to that shown in FIG. 2. Furthermore, although not shown in the drawings, instead of relying solely upon the shelf panels 49 to interconnect the adjacent pairs of posts, additional horizontal braces of a similar construction to the beams 15, but having imperforate vertical webs, are generally used to provide rigidity by interconnecting, for example, the two front posts 13 illustrated in FIG. 1.

The provision, of such an integral locking tab 41 is particularly advantageous because it is not only simple to construct as a part of the fabrication of the horizontal members, but it does away with the requirement for any separable latch or lock that could be lost or that would require separate handling during erection of the framework installation. The locking tab 41 remains always ready for use and can be simply and quickly tapped in place with a mallet or hammer. Once in place, the integrity of the framework is assured as inadvertent detachment is positively prevented. Although the locking tab 41 is preferably associated with the lower lug 33 of the pair as illustrated in respect of FIGS. 1 and 2, it can also be associated with the upper lug 33 as illustrated in FIGS. 3–5.

A slightly modified beam construction 15' is depicted in FIGS. 3, 4 and 5 of the drawings which is designed for use with decking in the form of wood planks or flat sheets of particle board or the like. Accordingly, instead of providing the upwardly open lips 47 depicted in FIGS. 1 and 2 to cooperate with the skirted metal shelves, the webs 27 of the channels are punched so as to provide a series of half loops 55 which extend horizontally outward from the plane of the web and which are spaced longitudinally along the beam 15'. The half loops 55 may extend, for example, about $\frac{3}{8}$ inch outward from the plane of the beam where the flanges 29, 31 measure about $\frac{1}{2}$ inch. The half loops 55 are preferably located mid-way vertically of the beam web 37 and provide excellent support for the edges of particle board decking. Of course, decking of this type does not serve the dual function of adding lateral (or fore-and-aft if rotated 90° from the orientation shown in FIG. 1) rigidity to the structure because it does not prevent the beams 15' from spreading apart. Accordingly, additional imperforate horizontal members may be used to tie the posts together in the direction perpendicular to that of the modified beams 15', and a flat tie bar 57 may be employed between the midpoints of opposite beams 15'. The ends 59 of the tie bar 57 are bent downward and then turned in slightly to fit through one of the half-loops 55. When in place, the tie bar 57 limits the amount that opposite beams 15' can spread apart.

In addition to the inclusion of the half loops 55 in place of the upwardly open lips 47, the modified beams 15' also have the locking tab 41 associated with the upper lug of the pair of lugs 33. As previously indicated, the locking tab 41 can be associated with either of the lugs, and it may be preferable to locate the tab as depicted in FIGS. 1 and 2 as it will occupy a more out-of-the-way location. However, in either position, the tab 41 operates in the same manner, as perhaps best seen in FIG. 5. After the beam is in place, by tapping the root portion 43 lightly with a hammer, the slanted head 45 enters and substantially fills the upper region of the slot 25. If the beam lugs 33 had not been fully seated in the slots 25 in the post, the slanted upper surface of the head 45 exerts a camming action that drives the beam downward.

Figure 7:
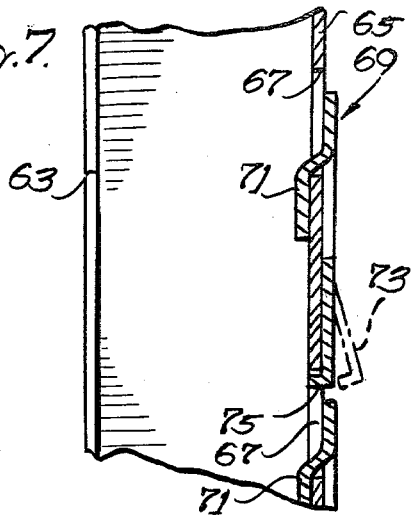
FIG. 7 is an enlarged sectional view taken along line 7—7 of FIG. 6, showing the beam locked to the post.

Depicted in FIGS. 6 and 7 is a different type of a connector arrangement for joining a support member or beam 61 to a post 63. The front face 65 of the post 63 is provided with two rows of rectangular holes 67 uniformly vertically spaced from one another. Affixed, as by welding, to the end of the beam 61 is an angle iron connector 69 which is adapted to abut the front and adjacent side faces of the post 63. The front face of the connector has a pair of rearwardly and downwardly extending lugs or prongs 71 formed therewithin which are spaced apart the same distance as the rectangular slots 67. Accordingly, as the angle iron connector 69 is brought into contact with the post 63, the pair of prongs 71 enter the slots 67. As the beam 61 is then moved downward, the prongs 71 slide downward in the slots and engage the rear surface of the front wall 65 of the post, as depicted in FIG. 7.

In order to lock the beam 61 in this installed position, an integral locking tab 73 is punched from the front wall 65 of the angle iron connector at a location between the two prongs 71. The locking tab 73 includes a short perpendicular head 75 which in its original position, as shown in dotted outline in FIG. 7, lies slightly outside the plane of the front flange of the angle iron connector 69. Once the beam 61 has been moved downward to its fully installed position, the perpendicular head 75 of the locking tab 73 is aligned with the upper region of the slot 67 in which the lower prong 71 resides. Thus, by tapping the locking tab 73 with a hammer, it swings about a horizontal axis, and the head 75 enters the slot 67 as depicted in FIG. 7. This completes the locking operation, and the beam and its affixed connector 69 cannot now be withdrawn from its mating relationship with the post 63 until the locking tab 73 is pried outward so that its head 75 leaves the slot.

Figure 8:
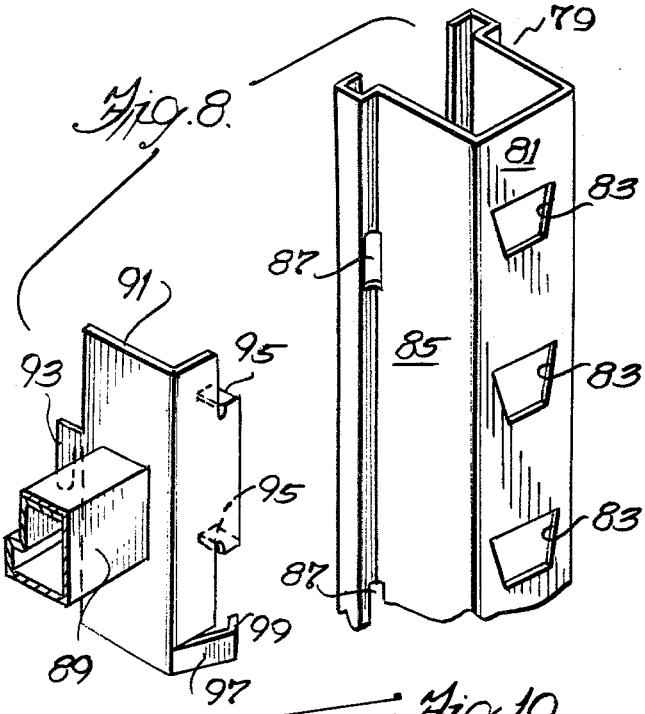
FIG. 8 is a fragmentary perspective view showing a connector of still a different design for joining a beam to a post, which connector also embodies various features of the present invention.

FIG. 8 depicts still another version of a beam and post connection arrangement, of the general type illustrated in U.S. Pat. No. 3,127,995. Illustrated is a vertical post or column 79 which has a generally channel-shaped cross section, with the web 81 of the channel being provided with a series of vertically spaced apertures in the form of keystone-shaped openings 83. Each of the flanges 85 of the channel has its end turned outward, and a series of vertically spaced slots 87 are provided in the regions at the end edges of the flanges. A box-like beam or support member 89 is affixed, as by welding, to an angle iron connector 91 at each end. The flange of the angle iron connector 91 which is attached to the beam 89 is formed with at least one rearwardly protruding hook 93 that is proportioned to enter the slots 87. The other flange of the connector 91 is formed with a pair of inturned lugs or tabs 95 which are spaced apart the same distance as the slots 83 in the web and are designed to be received in the keystone slots 83.

Also formed in the front flange of the connector 91 is a locking tab 97 having a short perpendicular-extending head 99. When the beam 89 is mated with the post so that the hook 93 is received in a slot 87 and the tabs 95 are received in the uppermost two openings 83 and is then moved downward to effect a tight fit, as a result of the inherent wedging action, the head 99 of the locking tab 97 becomes aligned with the upper region of the third slot 83 depicted in FIG. 8. Accordingly, when the locking tab 97 is tapped with a hammer, it swings about a vertical axis so that the head 99 enters the upper region of the opening 83. This effects locking because, it is attempted to move the beam 89 upward, the head 99 will abut the upper horizontal edge of the keystone opening 83 and prevent further upward movement and disengagement of the beam 89 from the column 79.

Figure 9:
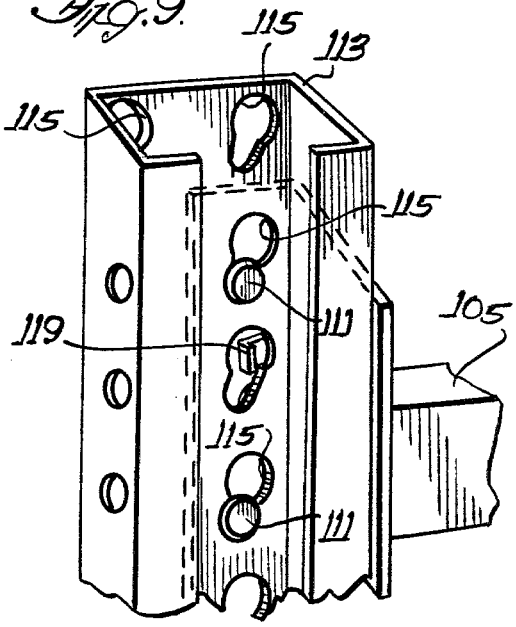
FIG. 9 is a fragmentary perspective view of a connector of still another design which is affixed to a beam that is shown mated to a post.

Depicted in FIG. 9 is still another type of connection which might be employed in an adjustable pallet rack or the like, of the general type illustrated in U.S. Pat. No. 3,303,937. An angle iron connector plate 101 has one flange 103 which is welded to the end of a support member or beam 105 while the other flange 107 is provided with a pair of studs or lugs 109 that include enlarged head portions 111. Posts or columns 113 with which the beams 105 are designed for connection are provided, in their front face, with two rows of vertically spaced apertures in the form of keyhole slots 115. As seen in FIG. 9, the studs 109 are spaced apart a distance equal to twice the vertical spacing between the keyhole slots 115.

When the beam 105 is brought into engagement with the post, the enlarged heads 111 of the studs 109 fit through the larger upper portions of the keyhole slots 115. As the beam and its connector 101 are moved downward, the studs 109 slide into the lower smaller diameter portion of the keyhole slots 115, and the camming action draws the flange 103 of the connector into tight contact along the abutting side of the post 113.

In order to lock the beam to the post, a locking tab 119 is formed in the flange 107 of the connector at a location between the upper and lower studs 109. The locking tab 119 is located slightly closer to the upper stud 109, and when the beam 105 is secured to the post 113, the head of the locking tab 119 is aligned with the upper portion of the keyhole slot 115 in the column 113 between the pair of slots which receive the studs 109. By tapping the locking tab with a hammer, it is caused to pivot about a vertical axis so that the head enters the keyhole slot 115. Once in this locked position, disengagement of the beam 105 from the column 113 is prevented until the locking tab 119 is pried outward so that its head will no longer engage the upper edge of the keyhole slot 115.

Figure 10:
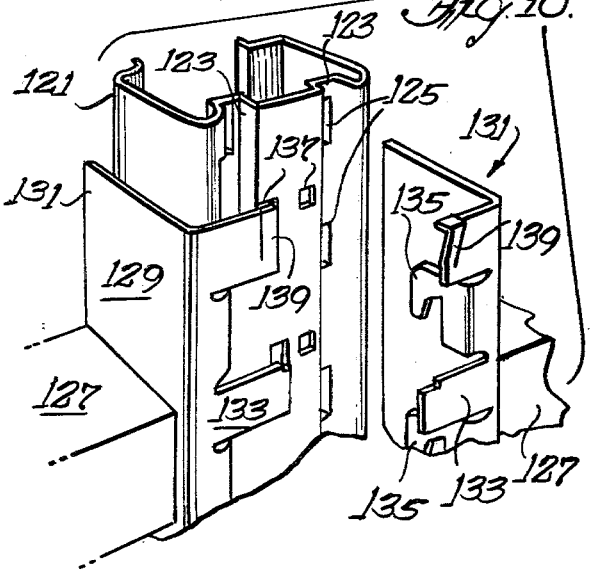
FIG. 10 is a perspective view showing a still further construction of a post plus a pair of beams and affixed connectors which embody features of the present invention.

Depicted in FIG. 10 is still another type of connection that might be employed in an adjustable pallet rack of the general type which is illustrated in U.S. Pat. No. 4,067,445. In this construction, a column 121 is provided of somewhat complex cross section, but generally in the shape of a channel wherein the web is deformed to provide a pair of re-entrant grooves 123. Slots or apertures 125 are provided at the base of the grooves 123 at spaced vertical intervals. Each end of the support member or beam 127 is affixed to a flange 129 of an angle iron connector 131. The other flange 133 of the angle iron connector 131 is punched and bent to form a pair of lugs or hooks 135 which are spaced apart a distance equal to the spacing between the slots 125.

The central portion of the web of the column 121 is formed with a series of spaced square holes or apertures 137 arranged adjacent each groove 123. To effect locking of the beam 127 to the column 121, a locking tab 139 is formed in the flange 133 having a head which, after the hooks 135 have entered the slots 125 and moved downward therein, is aligned with one of the square holes 137. Thus, when the locking tab 139 is tapped into position by a hammer, it pivots about a horizontal axis, and the head enters the slot 137, as depicted in respect of the left-hand connector in FIG. 11. So long as the head of the locking tab 139 resides in the square hole 137, the beam 127 and its affixed connector 131 cannot be moved upward to effect disengagement and are locked together until released.

Figure 11:
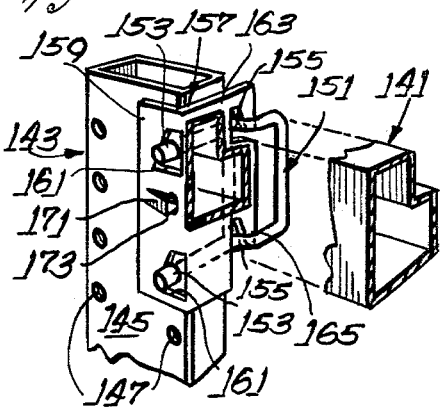
FIG. 11 is a fragmentary perspective view showing yet another connector design which joins a beam to a post and locks them together.

Depicted in FIG. 11 is a structural connection for joining a beam 141 to a column 143 of the general type illustrated in U.S. Pat. No. 2,932,368. The illustrated column 143 is rectangular in cross section, and its front face 145 has two rows of vertically spaced apertures or holes 147 disposed generally adjacent each edge. The exact same hole pattern is provided in the rear face, and these holes 147 accommodate a connector pin 151 which is inserted through the rear surface of the column at the appropriate vertical level. The pin has a pair of parallel legs 153 which extend completely through the column 143 and protrude from the front surface and a linking portion, which includes a pair of pin sections 155 disposed at 90° to the aforementioned legs.

The horizontal beam 141 is welded or otherwise suitably affixed at each end to a connector plate 157 in the form of an angle iron. A front flange 159 of the angle iron connector plate 157 is provided with a pair of closed slots 161 which have an upwardly slanting, camming edge. The other flange 163 of the connector which is welded to the end of the beam 141 has a pair of open slots 165. When the beam 141 is brought into abutting relation with the column, the ends of the legs 153 of the pin protrude through the closed slots 161 while the transverse pin sections 155 are aligned below the open slots 165. As the beam is then moved downward, the camming surfaces of both pairs of slots pull the angle iron connector 157 into a close fit with the adjacent two surfaces of the column.

A locking tab 171 is punched from the front flange 159 of the connector at a location between the pair of closed slots 161. The locking tab 171 includes a short head 173 that is formed at about 90° to a root section, and the head 173 preferably has a slanting upper edge. The head 173 of the locking tab is aligned with the aperture 147 in the column located between the two apertures wherein the connector pin 151 resides. Tapping the locking tab with a hammer drives the head 173 into the aperture, and if the beam 141 has not already been moved downward to its fully seated location, the camming action of the upper slanting surface of the head 173 against the upper edge of the aperture 141 forces the connector downward to its fully seated position. Thus, the beam 141 is locked to the column 143 because the slotted portions of the angle iron connector 157 cannot be disengaged from the pin connector 151, as relative upward movement is prevented by the residence of the head 173 in the aperture 147.

Although the invention has been described with respect to certain preferred embodiments, it should be understood that changes and modifications as would be obvious to one having the ordinary skill in the art may be made without departing from the scope of the invention which is defined solely by the claims appended hereto. For example, although only the locking tabs 41 are illustrated with a slanted edge to facilitate entry into the opening and final seating of the connector, other of the illustrated tabs could be likewise so formed.

Various features of the invention are emphasized in the claims which follow.

What is claimed is:

1. A rack structure for supporting items at different vertical levels which incorporates vertical posts each having two vertical rows of narrow vertical slots at predetermined locations, longitudinal metal support members each including an integrally formed connector located at the end of a longitudinally-extending vertical wall portion that joins said members to said posts in supported relationship thereon, said connectors having hook-like appendages which are bent at about 90° to the longitudinal axis of said member and which enter said narrow slots and interengage with the bottom edges thereof upon downward movement of said members relative to said posts, and locking tab means for positively preventing disengagement of said members from said posts, said locking tab means being integrally formed from said member at a location immediately adjacent and above one of said connector appendages, said tab means being displaceable into the upper region of said narrow slot wherein said adjacent connector appendage is received following downward movement of said connector to thereby block disengagement of said member from said post until said locking tab means is first withdrawn and to thus lock said member to said post, said locking tab means having a tapered head portion and a root portion, said head portion having an upper edge which slants upward from a narrow end portion that first enters said slot and being oriented at about 90° to said root portion, said root portion being displaced from said vertical wall portion of said support member and said head portion of said tab means being offset from vertical alignment with said adjacent connector appendage before said tab is moved to locking position, and said root portion being joined to the remainder of said member along a generally vertical line so that said tab means moves in a generally horizontal plane as it is displaced into locking position, whereby said upper slanting edge engages the upper edge of said narrow slot and effects camming movement as a result of movement relative to said post.

2. A rack structure in accordance with claim 1 wherein a plurality of said hook-like appendages are provided as a part of each connector and wherein said locking tab means is located vertically between two of said appendages in each connector.

3. A rack structure for supporting items at different vertical levels which comprises at least four vertical posts, each post having two vertical rows of narrow vertical slots at predetermined locations, longitudinal metal beams extending between and interconnecting pairs of said posts, which beams each include a longitudinally extending vertical wall section and integrally formed connectors located at opposite ends thereof that are operable to join said beams to said posts, said connectors having hook-like appendages which are bent at about 90° to the longitudinal axis of said beams and which enter said narrow slots and interengage with the bottom edges thereof upon downward movement of said beams relative to said posts, a plurality of shelf supports in the shape of continuous half loops being punched from said vertical wall section of said beams, a tie strap having a hook at each end interconnecting said half-loops of two beams that are supported between opposite pairs of posts, horizontal shelves supported upon said shelf supports of said two beams, and locking tab means for positively preventing disengagement of said beams from said posts, said locking tab means being integrally formed from said beam at a location immediately above an adjacent connector appendage, said tab means being displaceable into the upper region of said narrow slot wherein said adjacent connector appendage is received following downward movement of said beam to thereby block disengagement of said beam from said post until said locking tab means is first withdrawn and to thus lock said beam to said post, said locking tab means having a tapered head portion and a root portion, said head portion having an edge which slants upward from a narrow end which first enters said slot and being oriented at about 90° to said root portion, said root portion being displaced from said vertical wall section of said beam, said head portion of said tab means being offset from vertical alignment with said adjacent connector, and said root portion being joined to the remainder of said beam along a generally vertical line so that said tab means moves in a generally horizontal plane as it is displaced into locking position.

* * * * *